US007802410B2

(12) United States Patent
Breaz

(10) Patent No.: US 7,802,410 B2
(45) Date of Patent: Sep. 28, 2010

(54) MODULAR ELEMENTS, NETWORK, SUPPORTING STRUCTURE, CONSTRUCT

(76) Inventor: Laurentiu Dumitru Breaz, Str. 8 Martie nr. 9, 515200 Aiud, jud. Alba (RO)

( * ) Notice: Subject to any disclaimer, the term of this patent is extended or adjusted under 35 U.S.C. 154(b) by 0 days.

(21) Appl. No.: 12/067,697

(22) PCT Filed: Aug. 7, 2006

(86) PCT No.: PCT/RO2006/000016

§ 371 (c)(1),
(2), (4) Date: Mar. 21, 2008

(87) PCT Pub. No.: WO2007/081233

PCT Pub. Date: Jul. 19, 2007

(65) Prior Publication Data

US 2008/0250736 A1 Oct. 16, 2008

(30) Foreign Application Priority Data

Sep. 22, 2005 (RO) ..... 05-0806

(51) Int. Cl.
*E04B 2/00* (2006.01)
*E04C 2/26* (2006.01)

(52) U.S. Cl. ..... 52/503; 52/606; 52/607; 52/284; 446/85; 446/106

(58) Field of Classification Search ..... 52/503, 52/504, 505, 425, 284, 604, 605, 606, 607, 52/439, 437, 419, 565, 596; 446/85, 106, 446/117, 118, 122; 405/284, 286
See application file for complete search history.

(56) References Cited

U.S. PATENT DOCUMENTS 314,022 A * 3/1885 Heard ..... 52/605
756,300 A * 4/1904 Underwood ..... 52/284
1,216,840 A * 2/1917 Ramsey ..... 446/122

(Continued)

FOREIGN PATENT DOCUMENTS

DE 2156006 7/1973

(Continued)

*Primary Examiner*—Robert J Canfield
*Assistant Examiner*—Babajide Demuren
(74) *Attorney, Agent, or Firm*—Andrew Wilford

(57) ABSTRACT

The invention relates to modular elements made of insulating materials for constructions, provided with at least one network element in the interior; to a network obtained by connecting modular elements; to a supporting structure achieved by casting a hardening material in the network achieved by connecting the modular elements and joining them through the supporting structure, as well as to the process for obtaining thereof. The modular element has an interior network element made up of at least two main half joints and optionally it may have one or more secondary half-joints, connected through vertical and oblique channels. The network obtained by assembling the modular elements is made up of main and secondary joints, connected trough vertical, horizontal and oblique channels. The unitary supporting structure is obtained by casting a material that will be harden in the unitary network for the entire construction. The process for obtaining the construction according to the invention consists of the following: connection of modular elements and the casting of material that hardens in the network defined through the connection of modular elements and the creation of a unitary supporting structure.

17 Claims, 7 Drawing Sheets

U.S. PATENT DOCUMENTS 1,524,146 A * 1/1925 Murray ..... 52/302.4
1,649,780 A * 11/1927 Robbins ..... 52/609
2,493,435 A * 1/1950 Arehambault ..... 446/122
2,703,487 A * 3/1955 Ossoinack ..... 52/592.3
2,720,779 A * 10/1955 Earnest ..... 52/444
2,843,971 A * 7/1958 Gardellin ..... 446/126
3,232,017 A * 2/1966 Prusinski et al. ..... 52/309.9
3,430,404 A * 3/1969 Muse ..... 52/439
3,546,833 A * 12/1970 Perreton ..... 52/314
3,681,870 A * 8/1972 Alpert ..... 446/122
3,766,699 A * 10/1973 Dinkel ..... 52/591.4
3,890,751 A * 6/1975 Caputo et al. ..... 52/166
4,326,354 A * 4/1982 Hagberg ..... 446/126
4,532,745 A * 8/1985 Kinard ..... 52/251
4,964,833 A * 10/1990 Suzuki ..... 446/118
4,996,813 A * 3/1991 Kliethermes et al. ..... 52/592.1
5,003,746 A * 4/1991 Wilston ..... 52/592.1
5,350,256 A * 9/1994 Hammer ..... 405/286
5,487,623 A * 1/1996 Anderson et al. ..... 405/286
5,488,806 A * 2/1996 Melnick et al. ..... 52/425
5,540,525 A * 7/1996 Miller et al. ..... 405/284
5,560,171 A * 10/1996 McCoy ..... 52/592.6
5,562,519 A * 10/1996 Loewenton ..... 446/126
5,566,521 A * 10/1996 Andrews et al. ..... 52/606
5,586,841 A * 12/1996 Anderson et al. ..... 405/286
5,704,781 A * 1/1998 Swoboda ..... 432/119
5,839,243 A * 11/1998 Martin ..... 52/439
5,924,247 A * 7/1999 Van Horn et al. ..... 52/100
5,950,397 A * 9/1999 Ginn et al. ..... 52/742.14
5,966,889 A * 10/1999 Zinner ..... 52/606
5,992,119 A * 11/1999 Rokhlin ..... 52/596
6,253,519 B1 * 7/2001 Daniel ..... 52/591.1
6,318,041 B1 * 11/2001 Stanley ..... 52/505
6,588,168 B2 * 7/2003 Walters ..... 52/604
6,691,485 B1 * 2/2004 Prokofyev ..... 52/604
6,705,057 B2 * 3/2004 Smyer, III ..... 52/606
7,063,481 B2 * 6/2006 Trull ..... 403/170
2003/0029118 A1 * 2/2003 Grau ..... 52/596
2006/0185308 A1 * 8/2006 Lin ..... 52/596

FOREIGN PATENT DOCUMENTS

JP 404155040 A * 5/1992
WO WO-0079068 12/2000

* cited by examiner

MODULAR ELEMENTS, NETWORK, SUPPORTING STRUCTURE, CONSTRUCT

CROSS REFERENCE TO RELATED APPLICATIONS

This application is the US national phase of PCT application PCT/RO2006/000016, filed 7 Aug. 2006, published 19 Jul. 2007 as WO2007/081233, and claiming the priority of Romanian patent application a200500806 itself filed 22 Sep. 2005, whose entire disclosures are herewith incorporated by reference.

FIELD OF THE INVENTION

The invention relates to modular elements made of insulating materials for constructions, provided with at least one network element in the interior; to a network obtained by connecting modular elements; to a supporting structure achieved by casting a hardening material in the network achieved by connecting the modular elements and joining them through the supporting structure, as well as to the process for obtaining thereof.

BACKGROUND OF THE INVENTION

The concrete panels are used in a wide range of applications in the civil engineering industry, the construction time being thus reduced. The pre-cast panels are manufactured by casting the concrete into forms (concrete forming. After hardening, the panels are vertically positioned at the construction site.

Since the panels are not insulated there is an disadvantage in insulating them at a later stage, as insulating operations are expensive and imply a lot of manual working.

Another disadvantage is they could not be used for ceilings, as they have not sufficient strength in the case of large-sized ceilings.

The patent US 2002017070 describes an expanded plastic module intended for the building of a concrete wall structure, insulated by interconnecting the modules and filling them with concrete. The module is made of expanded polystyrene. Each module has the form of a rigid block, having an interior configuration designed to be filled with concrete. Additionally, for the increase of strength, a network of steel or plastic bars is being introduced inside the modules. The disadvantage of this technical solution consists in a high rate of concrete consumption, flow problems upon the placing of concrete, due to the internal passages, positioned perpendicularly along the vertical and horizontal line; also, a too complex construction and additional manual working, brought about by the network of bars.

The patent WO 2005059264 relates to polyurethanes or polystyrene foams for concrete structures.

The insulating blocks elements have an interior arrangement in the form of vertical cavities in a trapezoidal, circular, elliptical or parabolic shape. The structure obtained after the blocks have been filled with concrete has good strength properties and optimum heat insulation; moreover, the strength of the linear structure is inferior to the structures in which concrete is cast in several directions.

The U.S. Pat. No. 4,942,707 describes ceiling or roof structures, based on a rigid insulation, provided with several cavities or passages that become molds for the concrete during its casting. Following the joining of structures in the form of a ceiling or a roof, concrete is to be cast in these cavities or passages. The disadvantage of this technical solution is the high rate of consumption of concrete; also, it may be applied only to ceilings and roofs.

Another major disadvantage of insulating elements with interior passages for casting of concrete is that they become only elements of a building, such as walls, ceiling, not being able to meet the necessary features for obtaining an appropriate supporting structure for a complete construction.

OBJECT OF THE INVENTION

The problem solved by this invention is the achievement of a construction with a unitary structure of strength and appropriate heat insulation, without any elements of concrete forming, using a simple and cost effective procedure.

The purpose of this invention is the achievement of a unitary supporting structure that would be suitable for constructions, through the casting of a hardening material in a unitary network, defined and formed through the connection of modular elements made of insulating materials.

SUMMARY OF THE INVENTION

In accordance with one embodiment of the present invention, the modular element removes the previously mentioned disadvantages, as it has an interior network element made up of at least two main half-joint cavities and optionally it may have one or more secondary half-joint cavities, connected through vertical and oblique passages.

In accordance with another embodiment of the present invention, the modular element removes the previously mentioned disadvantages, as it has an interior network element made up of two main half-joints and two secondary half-joint cavities, connected through vertical and oblique passages.

In accordance with another embodiment of the present invention, the modular element removes the previously mentioned is disadvantages as it has an interior network element made up of four main half-joint cavities and two secondary half-joint cavities, connected through vertical and oblique passages. In accordance with another embodiment of the present invention, the modular element removes the previously mentioned disadvantages as it has an interior network element made up of four main half-joint cavities, connected through vertical and oblique passages.

In accordance with another embodiment of the present invention, the modular element removes the previously mentioned disadvantages, as it has an interior network element made up of two main half-joint cavities, and a parallelepiped, connected through vertical, horizontal and oblique passages. In accordance with another embodiment of the present invention, the modular element removes the previously mentioned disadvantages as it has in the interior three main open passages, two of which parallel and one perpendicular to the other two.

In accordance with another embodiment of the present invention, the modular elements removes the previously mentioned disadvantages as they have an odd number of joint elements and at least two joint elements, respectively, or four joint elements equally positioned in the upper and lower part. In accordance with one embodiment of the present invention, the network obtained by assembling the modular elements removes the previously mentioned disadvantages as it is made up of main and secondary joints, connected trough vertical, horizontal and oblique passages. In accordance with another embodiment of the present invention, the unitary supporting structure removes the above mentioned disadvantages, as it is obtained by casting a material that will be harden in the unitary network for the entire construction.

In accordance with another embodiment of the present invention, the construction removes the previously mentioned disadvantages as it is made up of a unitary supporting structure inside of an insulating structure, obtained by connecting the modular elements.

In accordance with another embodiment of the present invention, the process for obtaining the construction according to the invention removes the disadvantages mentioned above as it consists of the following: connection of modular elements and the casting of material that hardens in the network defined through the connection of modular elements and the creation of a unitary supporting structure.

According to the invention, the modular elements are made of synthetic foams based on polyurethanes, polyamides, polyethylene, polypropylene, polyvinyl chloride, polyvinylidene chloride, amino resins, phenolic resins, silicones, expanded polystyrene and sodium silicate. The network elements are joints having a cylindrical, spherical, prismatic or tapered form, connected through vertical, oblique or horizontal passages, as well as open passages which intersect each another perpendicularly.

The material to be cast in the network according to the invention, in order to harden and form the supporting structure may be one of the following: concrete, reinforced concrete, polyester resins, epoxy resins, polyurethane resins.

For example, the construction procedure for one-floor building includes the connection of modular elements for the foundation, walls, ceiling, roof in a vault shape, and the cast of material in the network defined by specific modular elements: the material hardens and forms the supporting structure which is Unitary in the building assembly, but specific for each part of the building. The following advantages are obtained by the application of this invention:

- the achievement of a construction with a unitary structure of strength and appropriate heat insulation, without any elements of concrete forming, using a simple and cost effective procedure
- the construction is achieved in shorter time in comparison with traditional processes;
- the resistance of the construction is higher in comparison with other processes;

BRIEF DESCRIPTION OF THE DRAWINGS

An example of achievement of the invention is given below in conjunction with accompanying drawings, wherein.

SPECIFIC DESCRIPTION

Example 1

Figure 1:
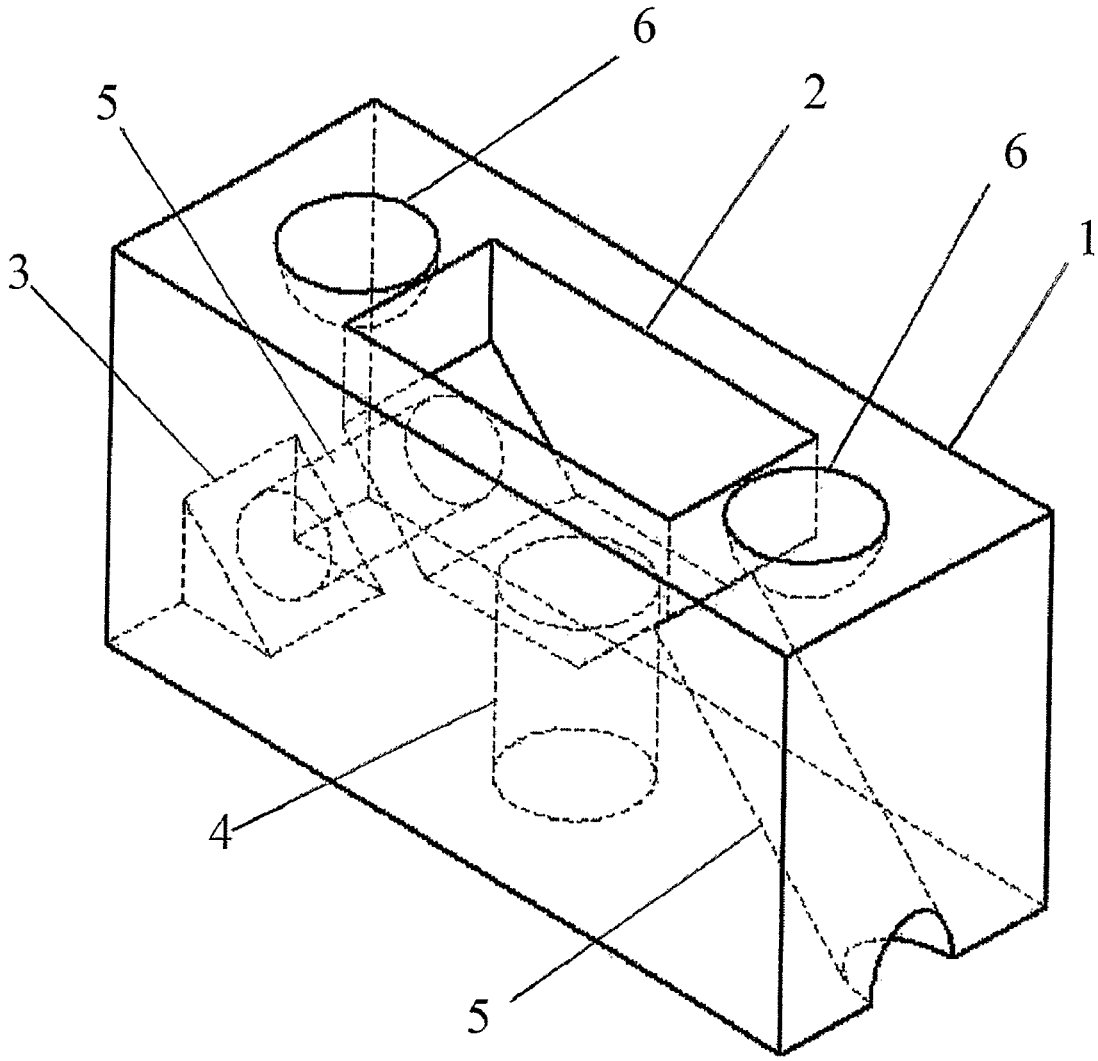
FIG. 1. Modular element 1 having in interior a network element consisting of a main half-joint cavity 2, a secondary half-joint cavity 3 connected through vertical passage 4 and oblique passages 5 and two-joint elements 6.
Figure 2:
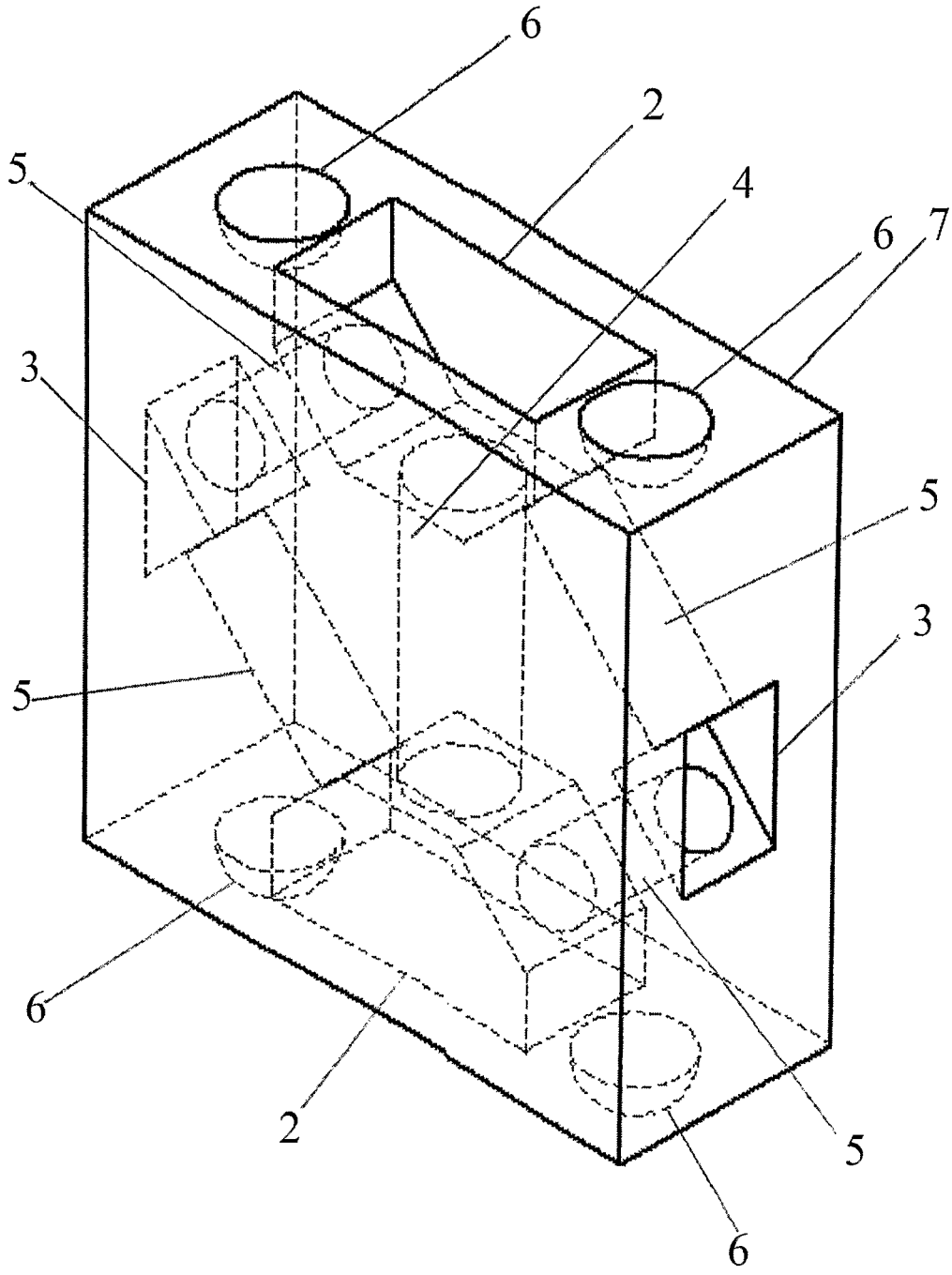
FIG. 2. Modular element 7 having in the interior a network element consisting of two main half-joints 2, two secondary half-joint cavities 3 connected through vertical passages 4 and oblique passages 5 and four joint elements 6.
Figure 3:
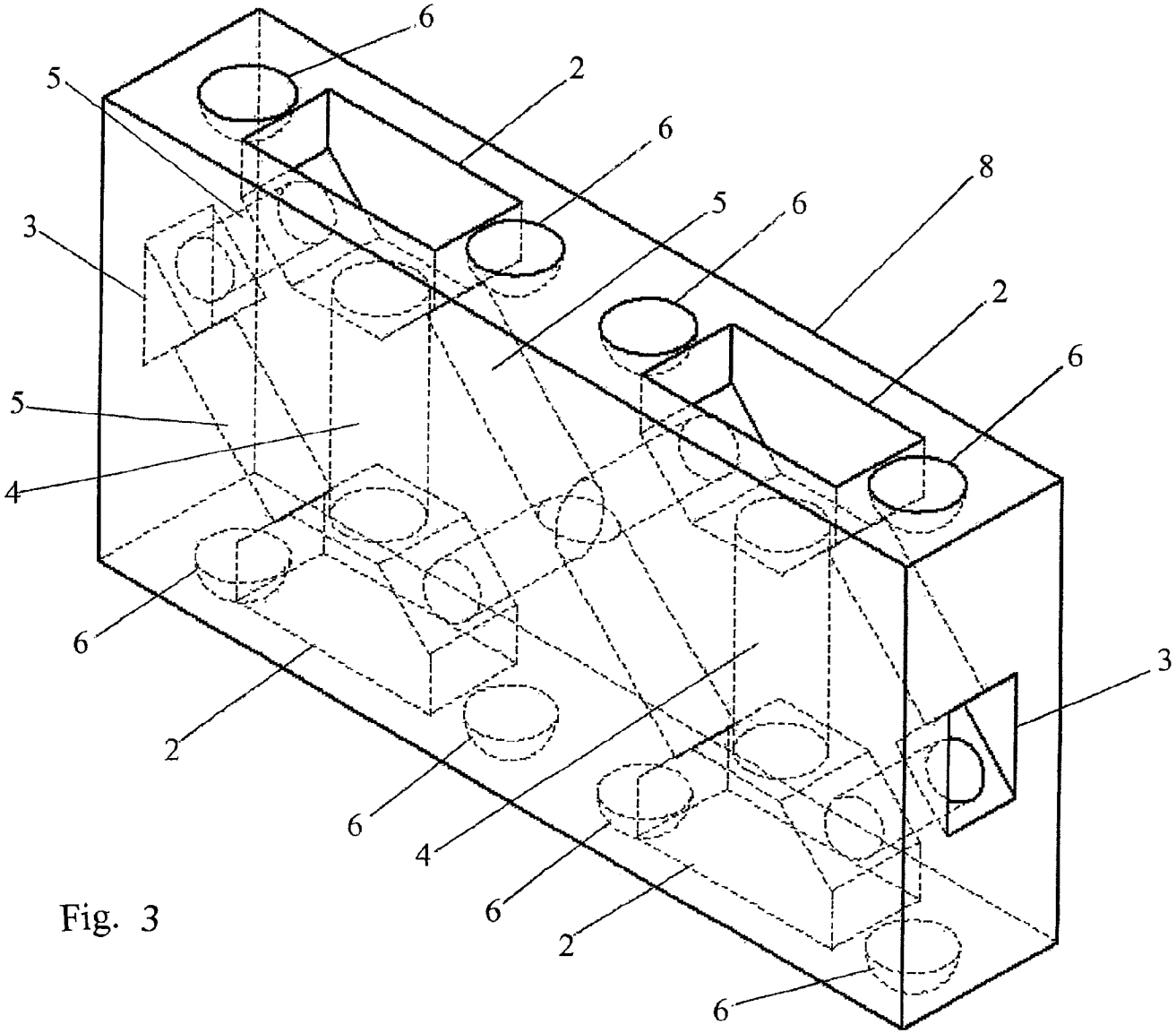
FIG. 3. Modular element 8 having in the interior a network element consisting of four main half-joints 2, two secondary half-joint cavities 3 connected through vertical passages 4 and oblique passages 5 and eight joint elements 6.
Figure 4:
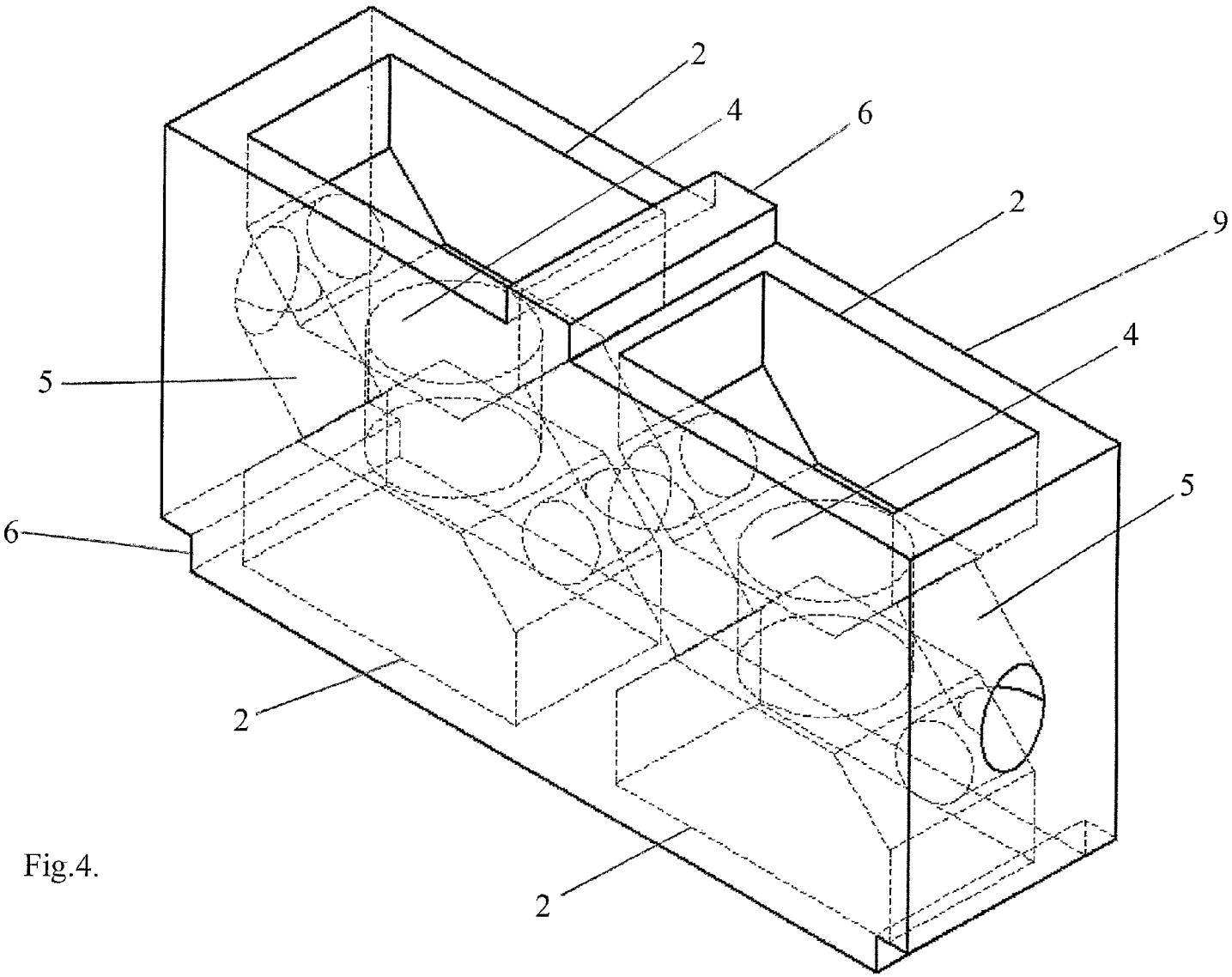
FIG. 4. Modular element 9 for the foundation having in the interior a network element consisting of four main half-joint cavity 2 connected through vertical passages 4 and oblique passages 5 and two joint elements 6, an upper one and a lower one.
Figure 5:
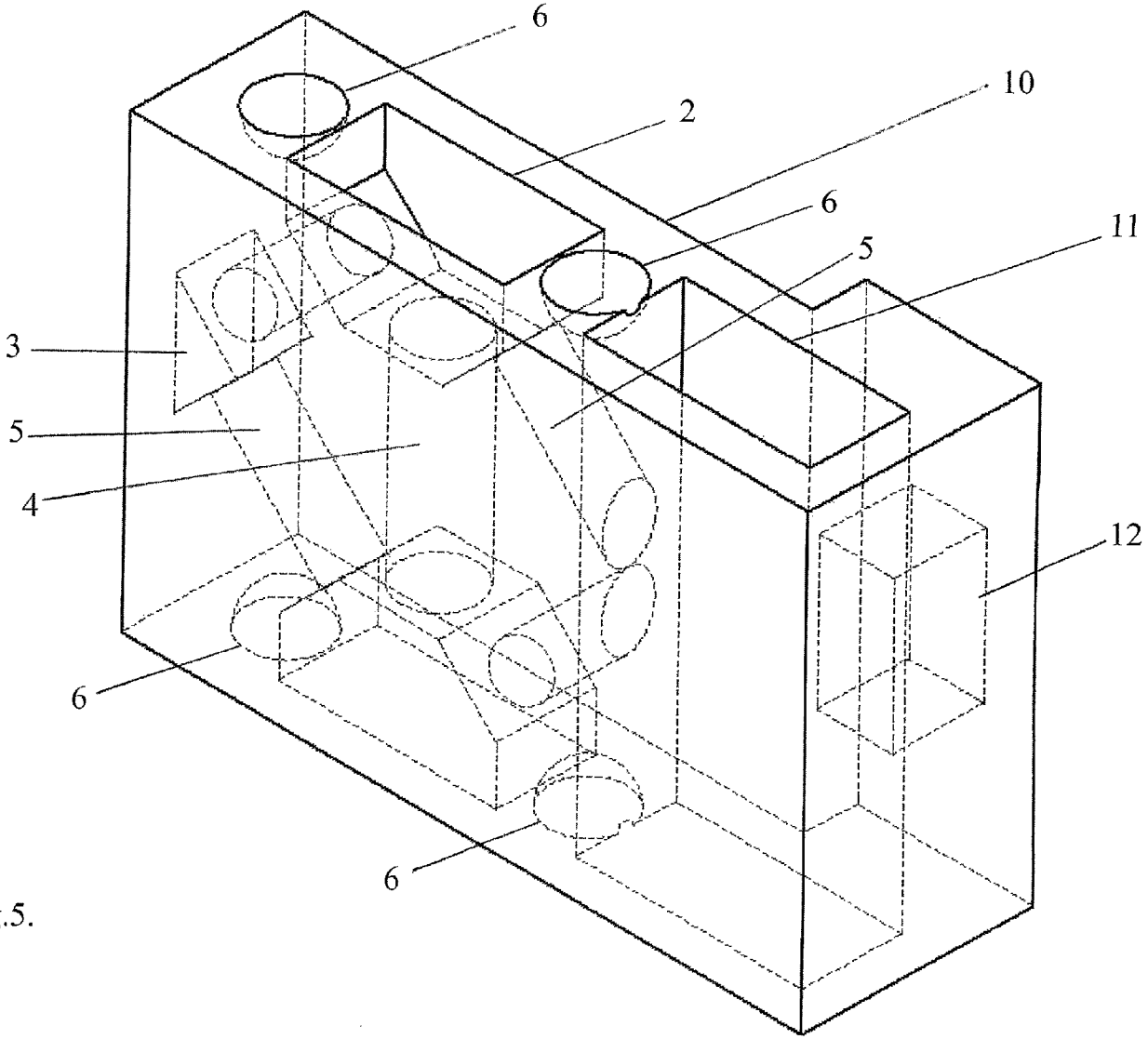
FIG. 5. Modular element 10 for the corner, having in the interior two main half joints 2, a parallelepiped 11 connected through vertical passages 4 and oblique passages 5 and horizontal passages 12 and four joint elements 6.
Figure 6:
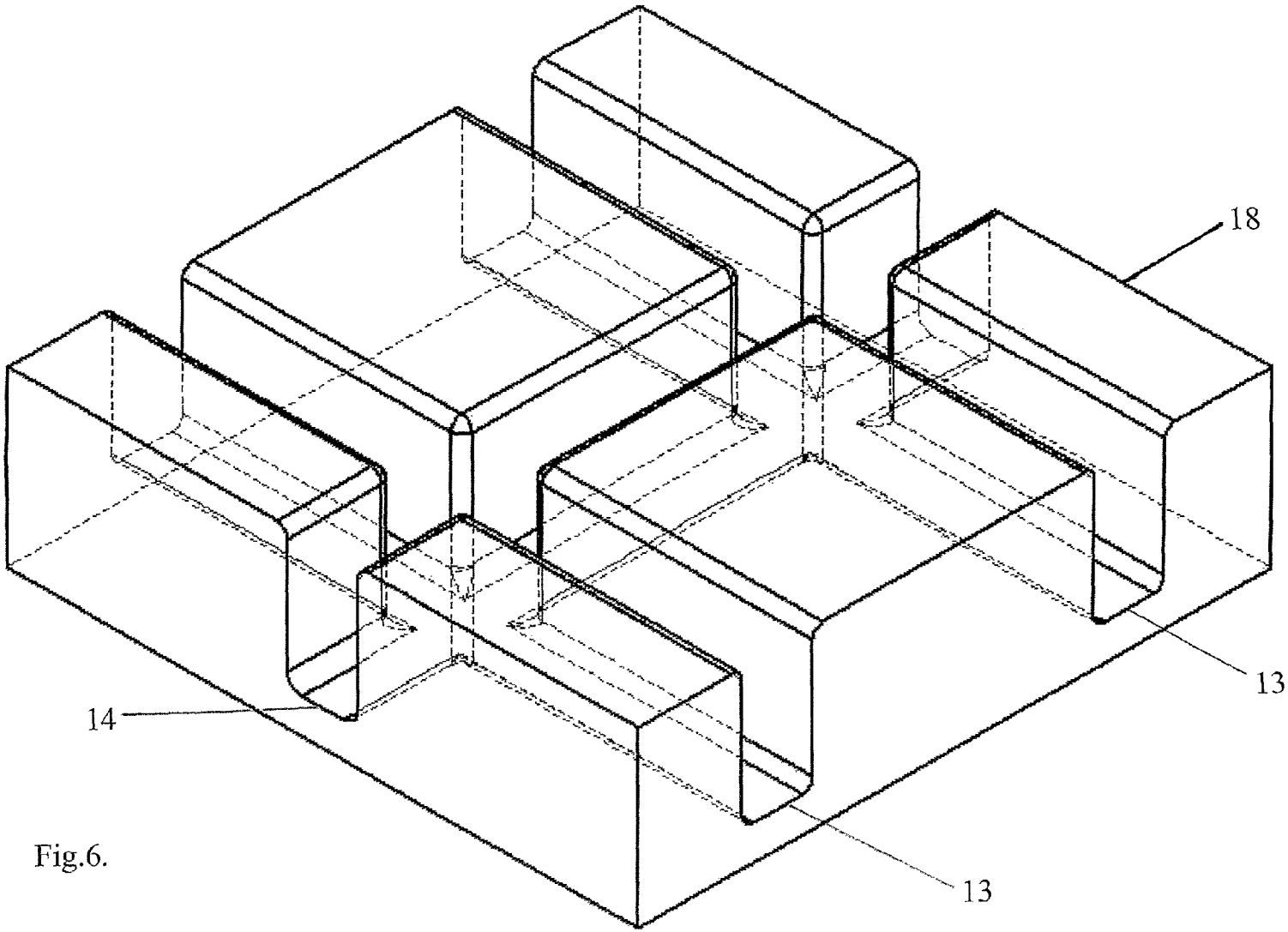
FIG. 6. Modular element 18 for the ceiling having in the interior three main open passages, two of which being parallel passages 13 and one passage 14 being perpendicular to the other two.

There are achieved modular elements for wall (FIG. 1), corner (FIG. 4), foundation (FIG. 5), ceiling (FIG. 6) from fireproofed polyurethane foam, by injecting in mold and expanding at the dimensions of the mold. The modular elements have the following dimensions: the modular element for wall has the dimensions 120/60/30 cm with vertical passages of 16 cm in diameter, oblique passages of 12 cm in diameter and joint element of 20 cm; the modular element for corner has the dimensions 120/60/30 cm for one side and 60/60/30 cm for the other side, with vertical passages of 16 cm in diameter, oblique passages of 12 cm in diameter and joint element of 20 cm; the modular element for foundation has the dimensions of 120/60/60 cm with vertical passages of 20 cm in diameter, oblique passages of 14 cm in diameter and joint element of 20 cm; the modular element for ceiling has the dimensions 120/60/20 cm with passages of 15/15 cm.

Figure 7:
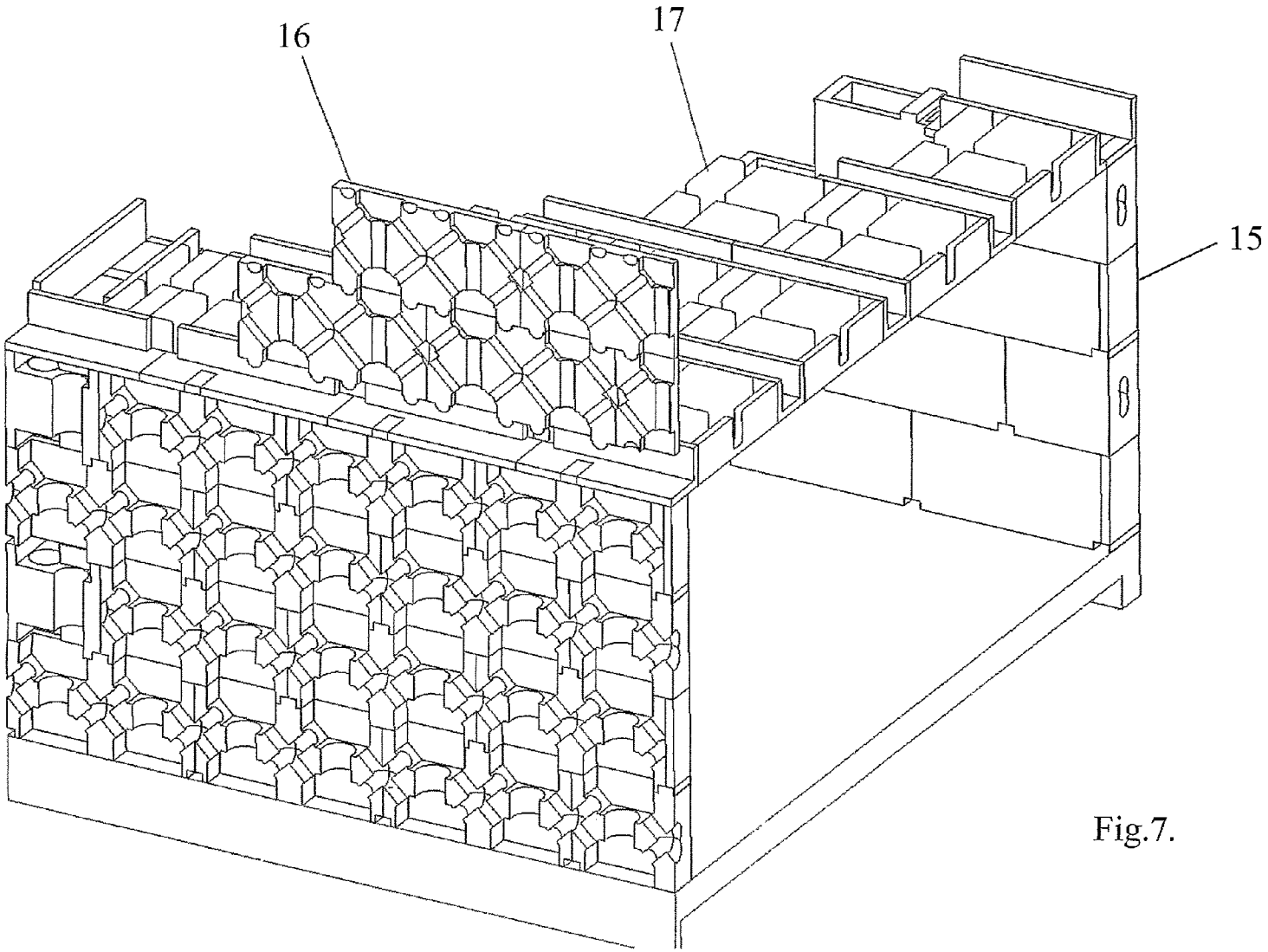
FIG. 7. Construction consisting of modular elements, making up the foundation 15, the wall 16 and the ceiling 17.

There is achieved the construction presented in FIG. 7 as following: the modular elements for foundation 15 and corner are assembled, than the modular elements for ceiling 17 and than the modular elements for the wall 16 and corner, followed by the casting of concrete B 300 with high fluidity in the formed network.

After hardening, the strength of the wall at stress is 100 tons/meter.

The invention claimed is:

1. A modular construction element comprising:

a rigid parallopipedal block having an upper face, a lower face, and four side faces extending vertically between the upper and lower faces, the block being formed with a main joint cavity opening at the upper face, respective secondary joint cavities opening at the side faces, a vertical passage opening into the main joint cavity and at the lower face, respective oblique passages flanking the vertical passage, each opening into a respective one of the secondary joint cavities, and both opening into the main joint cavity, and two vertically projecting joint elements on one of the upper and lower faces.

2. The modular construction element as defined in claim 1 wherein it is made up of four main half-joint cavities, two main half-joint cavities connected through vertical passages and oblique passages and eight joint elements.

3. The modular construction element as defined in claim 1 wherein it is made up to four main half-joint cavities, connected through vertical passages and oblique passages and two joint elements, one of which is upper and the other one is lower.

4. The modular construction element as defined in claim 1 wherein it has in the interior two main half-joint cavities, a parallelepiped, connected through vertical passages oblique passages and horizontal passages and four joint elements.

5. The modular element as defined in claim 1 wherein it has in the interior three main open passages, two of which parallel and another one perpendicular to the other two.

6. A network obtained by connecting the modular elements as defined in claim 1 wherein it is made up of main half-joint cavities and secondary half-joint cavities connected through vertical passages, horizontal passages, and oblique passages.

7. The modular elements defined in claim 1 wherein they are made up of synthetic foams, based on polyurethanes, polyamides, polyethylene, polypropylene, polymerized vinyl chloride, polyvinylidene chloride, amino resins, phenolic resins, silicones, expanded polystyrene or sodium silicate.

8. A unitary supporting structure comprised of a stack of the blocks as defined in claim 1 with lower faces of upper blocks sitting atop upper faces of lower blocks and with their passages forming a network and a cast mass of a hardening material in the network, the hardening material being concrete, polyester resins, epoxy resins, or polyurethane resins.

9. A construction of modular elements as defined in claim 1 wherein it is made up of a unitary supporting structure in the interior of an insulating structure, obtained through the connection of modular elements.

10. The modular construction element defined in claim 1 wherein the secondary cavities each open at a corner formed between the respective side face and the lower face.

11. The modular construction element defined in claim 1 wherein the secondary cavities are each positioned generally centrally in the respective side face at a vertical spacing from the upper and lower faces.

12. The modular construction element defined in claim 1 wherein the lower face is formed with a lower main cavity into which the vertical passage opens.

13. The modular construction element defined in claim 1 wherein the vertically projecting joint element is a part-spherical cavity.

14. The modular construction element defined in claim 1 wherein there are two of the vertically projecting joint elements on the one of the upper and lower faces and two complementary vertically open joint elements on the other of the upper and lower faces.

15. The modular construction element defined in claim 14 wherein the vertically projecting joint elements include a transverse ridge and the vertically open joint elements include a transverse groove.

16. The modular construction element defined in claim 15 wherein the transverse ridge is formed centrally on the upper face and two of the transverse grooves are formed at ends of the lower face.

17. The modular construction element defined in claim 1 wherein the block is also formed with two vertically opening joint elements complementary to the projecting joint elements on the other of the upper and lower faces.

* * * * *